US008341797B2

(12) United States Patent
Young

(10) Patent No.: US 8,341,797 B2
(45) Date of Patent: Jan. 1, 2013

(54) MOP SWAB HOLDER

(76) Inventor: Ronald Alexander Young, West Midlands (GB)

( * ) Notice: Subject to any disclaimer, the term of this patent is extended or adjusted under 35 U.S.C. 154(b) by 995 days.

(21) Appl. No.: 12/278,576

(22) PCT Filed: Oct. 11, 2006

(86) PCT No.: PCT/GB2006/003760

§ 371 (c)(1),
(2), (4) Date: Nov. 24, 2008

(87) PCT Pub. No.: WO2007/093754

PCT Pub. Date: Aug. 23, 2007

(65) Prior Publication Data

US 2009/0151100 A1 Jun. 18, 2009

(30) Foreign Application Priority Data

Feb. 14, 2006 (GB) ..... 0602876.5

(51) Int. Cl.
*A47L 13/20* (2006.01)

(52) U.S. Cl. ..... 15/228; 15/208; 15/209.1; 15/244.3

(58) Field of Classification Search ..... 15/208, 15/209.1, 223, 224, 228, 244.3, 147.1; 300/21
See application file for complete search history.

(56) References Cited

U.S. PATENT DOCUMENTS

| | | | | | |
|---|---|---|---|---|---|
| 101,777 | A | * | 4/1870 | Smith | 15/244.3 |
| 1,855,400 | A | * | 4/1932 | Krebs | 15/229.1 |
| 2,370,838 | A | * | 3/1945 | Brennan | 29/517 |
| 2,522,691 | A | * | 9/1950 | Podolak | 15/229.4 |
| 3,015,834 | A | * | 1/1962 | Marrinson et al. | 15/228 |
| 3,696,460 | A | * | 10/1972 | Moss | 15/229.1 |
| 3,763,517 | A | * | 10/1973 | Moss | 15/229.1 |
| 3,822,435 | A | * | 7/1974 | Moss | 15/229.8 |
| 3,924,289 | A | * | 12/1975 | Richards | 15/229.3 |
| 4,114,224 | A | * | 9/1978 | Disko | 15/229.2 |
| 4,288,884 | A | * | 9/1981 | Bahls | 15/244.1 |
| 4,313,774 | A | * | 2/1982 | Arthur | 156/73.1 |
| 4,441,228 | A | * | 4/1984 | Marquart et al. | 15/229.8 |
| 4,995,133 | A | * | 2/1991 | Newell | 15/229.1 |
| 5,217,787 | A | * | 6/1993 | Monahan | 428/134 |

(Continued)

FOREIGN PATENT DOCUMENTS

CA 2 350 376 A1 12/2001

(Continued)

OTHER PUBLICATIONS

UK Search Report, dated May 5, 2006 and issued in corresponding British Patent Application No. GB0602876.5.

(Continued)

*Primary Examiner* — Mark Spisich
*Assistant Examiner* — Michael Jennings
(74) *Attorney, Agent, or Firm* — Young & Thompson

(57) ABSTRACT

A swab (10, 110) for a mop includes an outer casing (14) and an inner filling (20), the outer casing (14) being made of an absorbent material and enveloping the inner filling (20), and the inner filling (20) being made of an absorbent material, opposite major surfaces (16, 18) of the outer casing (14) being attached together though the inner filling (20) to form depressions (28) in the opposite major surfaces (16, 18) of the outer casing (14) and to limit movement of the inner filling (20) within the outer casing (14).

16 Claims, 3 Drawing Sheets

U.S. PATENT DOCUMENTS

| | | | | |
|---|---|---|---|---|
| 5,884,355 | A * | 3/1999 | De Guzman | 15/229.2 |
| 6,143,393 | A * | 11/2000 | Abe et al. | 428/131 |
| 6,161,242 | A * | 12/2000 | Cabrero Gomez et al. | 15/147.1 |
| 6,245,413 | B1 * | 6/2001 | Kenmochi et al. | 428/157 |
| 6,270,166 | B2 * | 8/2001 | Weichelt et al. | 300/21 |
| 6,681,434 | B2 * | 1/2004 | Smith | 15/104.93 |
| 6,684,445 | B1 * | 2/2004 | Rios et al. | 15/120.1 |
| 6,685,274 | B1 * | 2/2004 | Rios et al. | 300/21 |
| 6,772,468 | B1 * | 8/2004 | Psik et al. | 15/229.2 |
| 7,516,510 | B2 * | 4/2009 | Tanaka | 15/228 |
| 7,624,468 | B2 * | 12/2009 | Reddy et al. | 15/104.94 |
| 7,735,180 | B2 * | 6/2010 | Tanaka | 15/209.1 |
| 7,775,170 | B2 * | 8/2010 | Zafiroglu | 112/475.08 |
| 7,937,797 | B2 * | 5/2011 | Tsuchiya et al. | 15/229.3 |
| 2002/0050016 | A1 * | 5/2002 | Willman et al. | 15/104.002 |
| 2003/0126702 | A1 | 7/2003 | Young | |
| 2003/0211802 | A1 * | 11/2003 | Keck et al. | 442/400 |
| 2003/0226227 | A1 * | 12/2003 | Rios et al. | 15/120.1 |
| 2004/0255421 | A1 * | 12/2004 | Kim | 15/244.3 |
| 2005/0000050 | A1 * | 1/2005 | Galvin et al. | 15/226 |
| 2005/0063765 | A1 | 3/2005 | Chase et al. | |
| 2005/0217047 | A1 * | 10/2005 | Young | 15/115 |
| 2005/0246851 | A1 | 11/2005 | Cline | |
| 2008/0166520 | A1 * | 7/2008 | Zafiroglu et al. | 428/136 |
| 2009/0151100 | A1 * | 6/2009 | Young | 15/147.1 |

FOREIGN PATENT DOCUMENTS

| | | | |
|---|---|---|---|
| DE | 44 27 672 | A1 | 2/1996 |
| JP | 5076567 | | 3/1993 |
| JP | 9047414 | A | 2/1997 |
| JP | 3042527 | U | 10/1997 |
| JP | 2003111706 | A | 4/2003 |
| JP | 2003284659 | A | 10/2003 |
| JP | 2005-601 | | 1/2005 |
| WO | 01/52713 | | 7/2001 |
| WO | 2005/107565 | A1 | 11/2005 |

OTHER PUBLICATIONS

Japanese Office Action, dated Aug. 19, 2011, in Application No. 2008-554832.

* cited by examiner

MOP SWAB HOLDER

DESCRIPTION OF INVENTION

This invention relates to a swab and more particularly, to a swab for use in a mop.

The invention is relevant to both a mop of the kind having a mop swab holder from which depends the mop swab, the mop in use being used primarily so that a lower part of the depending end of the mop swab contacts the surface to be mopped, and also a mop of the kind in which a mop swab attached to a mop swab holder is used flat against the surface to be mopped.

A mop of the kind in which the mop swab depends from the mop swab holder typically is intended, in use, to absorb a reasonably large amount of standing liquid on a surface to be mopped. A mop of the kind in which the mop swab is used flat against the surface to be mopped however is typically not intended to remove or hold large quantities of liquid but may be used, for example, to dry a surface to be mopped.

Mop swabs particularly for use in a mop of the kind in which the mop swab depends from a mop swab holder, are known, which include multiple strands of ribbon like material. The use of such multiple strands are beneficial since, even when fully charged with liquid, only a portion of the strands contact the surface being mopped, allowing easy movement without excessive drag. However, such multi strand mop swabs are expensive to produce as individual strands have to be made and then fastened together to form the mop swab, which is time consuming and expensive.

Mop swabs formed of multiple separate sheets of absorbent material are also known. Although this allows the swab to be more quickly produced, the sheets when charged with cleaning liquid may become heavy and due to a large portion being in contact with the surface being mopped, a significant amount of drag is created making it more difficult for a user to manoeuvre the swab when in use.

According to a first aspect of the invention we provide a swab for a mop, the swab including an outer casing and an inner filling, the outer casing being made of an absorbent material and enveloping the inner filling, and the inner filling being made of an absorbent material, opposite major surfaces of the outer casing being attached together though the inner filling to form a plurality of depressions in the opposite major surfaces of the outer casing and to limit movement of the inner filling within the outer casing.

The present invention provides a mop swab in which in use, by virtue of the depressions in the opposite major surfaces of the swab, as the swab is moved along a surface to be cleaned, the contact area between the swab and the surface is reduced, thereby reducing drag between the swab and the surface to be mopped, thus facilitating use of the mop.

Moreover, by virtue of the opposite major surfaces of the outer casing being attached together through the inner filling, rather than for example being bonded together, the swab may be formed with a plurality of pockets in each of which are voids e.g. between the outer casing and the inner filling in which in use, significant volumes of air may be trapped. It has been found that with a swab construction in accordance with the invention, cleaning of the swab is more efficient than with conventional mop swabs, because during wringing of the swab, the significant volumes of air trapped in the voids in the pockets of the swab, which are forced through the outer casing, very efficiently remove dirt which may be trapped by the material of the outer casing.

In a preferred arrangement, the opposite major surfaces of the outer casing are attached together though the inner filling by a plurality of spaced rows of stitching which extend generally in the same direction e.g. parallel to each other, so that the depressions in the opposite major surfaces of the outer casing, and thus the pockets formed, are elongate and extend generally in the same direction. Such elongate depressions may extend generally in the direction in which the swab is in use moved over the surface to be mopped and desirably extend over substantially the entire major surfaces of the swab. However cross stitching may also be provided as required further to limit movement of the inner filling within the outer casing, further to reduce drag in use, and to divide the lengths of the elongate pockets to maintain the cleaning efficiency of the swab during wringing.

The outer casing may be formed from a single sheet of absorbent material wrapped about the inner filling to form the opposite major surfaces, and the opposed three edges of the wrapped sheet being attached together with the inner filling interposed between the major surfaces, for example by stitching, so that the outer casing envelopes the inner filling.

Alternatively though, the outer casing may be formed from two separate sheets of absorbent material which provide the opposite major surfaces of the outer casing, and between which the inner filling is interposed, the four opposed edges of the two sheets being attached together e.g. by stitching, so that the outer casing envelopes the inner filling.

The absorbent outer casing may be made from a woven fabric material or from nonwoven fibre material, such as for examples only spunbond, meltblown, hydro-entangled, airlaid and carded nonwoven fibre material.

The inner filling may be an interlaced structure of any absorbent material such as for examples a matted absorbent material such as wadding, or a felted or woven fabric or nonwoven fibre or a mixture of any of these.

According to a second aspect of the invention we provide an assembly of a swab in accordance with the first aspect of the invention, and a mop swab holder.

The mop swab holder may include a channel from which in use, the swab depends, and fastening means to secure an edge of the mob swab therein.

The channel may be elongate or curved.

In another example, the mop swab holder may attach to one of the opposite major surfaces, whereby the mob swab in use, is used with the other major surface generally flat against a surface to be mopped.

In each case, the mop swab holder may include a handle fastening being one of a spigot and socket, by means of which a handle may be fastened to the mop swab holder.

According to a third aspect of the invention we provide a mop including in combination a swab and mop swap holder assembly of the second aspect of the invention, and a handle fastened to the mop swab holder.

According to a fourth aspect of the invention we provide a method a cleaning a swab of a mop of the third aspect of the invention in which the swab is formed with a plurality of pockets by the attaching together of the major surfaces of the outer casing through the inner filling, the pockets each including voids in which significant volumes of air are trapped, the method including one or both of inserting the mop swab into a cleaning liquid, and wringing the swab so that air trapped in the voids within the pockets, is forced outwardly through the absorbent material of the outer casing of the respective pockets.

According to a fifth aspect of the present invention we provide a method of making a swab of the first aspect of the invention, the method including forming an outer casing in an absorbent material, enveloping an inner filling of an absorbent material within the casing, attaching together opposite major surfaces of the outer casing though the inner filling to form depressions in the opposite major surfaces of the outer casing and to limit movement of the inner filling within the outer casing.

The method may include providing the inner filling as a web of absorbent material, and feeding the inner filling web between the opposite major surfaces of the outer casing, and attaching together opposed edges of the opposite major surfaces of the outer casing to envelope the inner filling.

Alternatively the inner filling may be provided as slivers of absorbent material which are placed between the opposite major surfaces of the outer casing, and then opposed edges of the opposite major surfaces are attached together to envelope the inner filling.

The step of attaching together the opposite major surfaces of the outer casing though the inner filling to form the depressions is preferably carried out simultaneously with but may be carried out subsequent to, or prior to, the step of attaching the opposed edges of the opposite major surfaces together.

The method may include subsequent to attaching together the opposite major surfaces of the outer casing, dividing the swab into a plurality of swab parts, each of which envelopes inner filling, each of the swab parts having in their opposite major surfaces, a plurality of depressions.

Each swab part may be used for a mop swab.

Embodiments of the invention will now be described by way of example only with reference to the accompanying drawings in which:—

Figure 1:
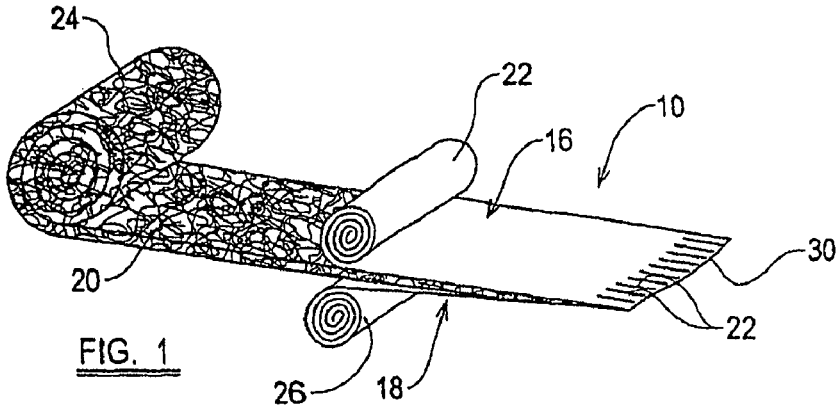
FIG. 1 is a diagrammatic view illustrating how a mop swab according to the invention may be made.
Figure 2:
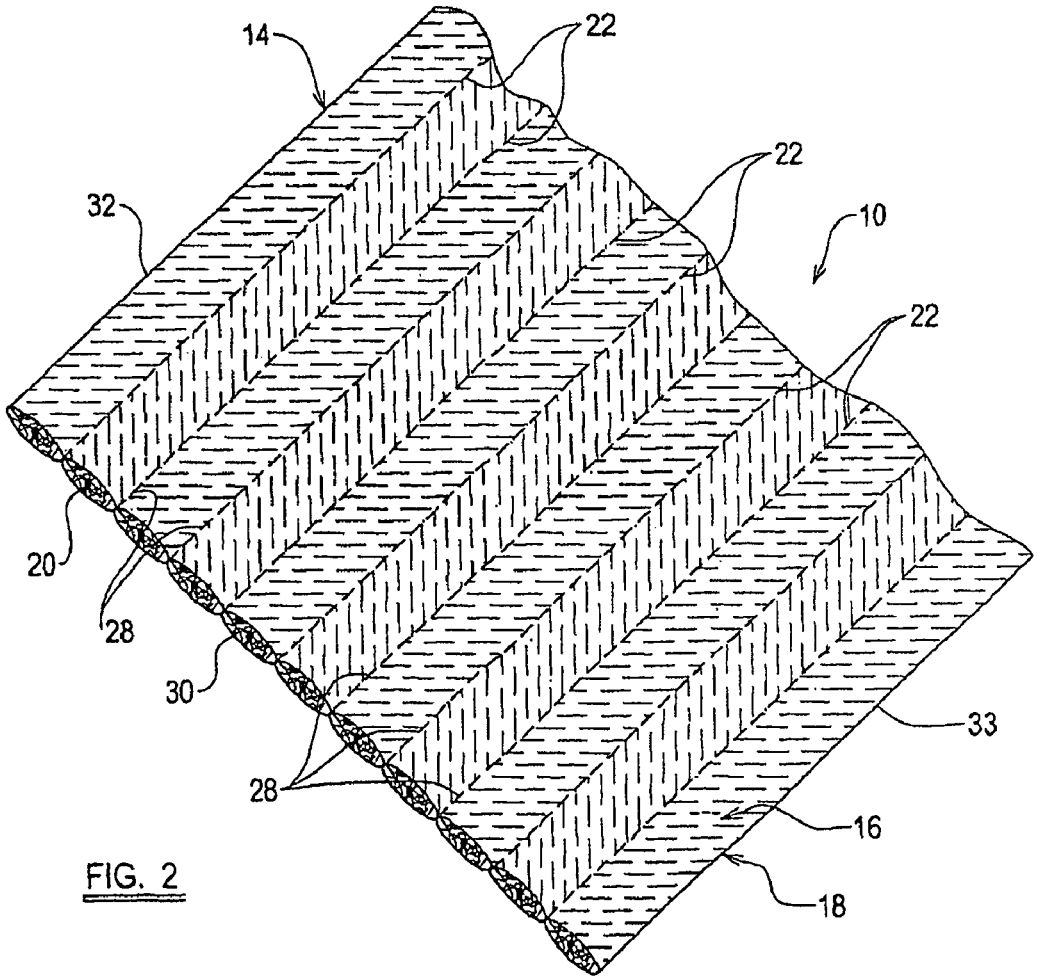
FIG. 2 is an illustrative perspective view of a mop swab in accordance with the invention at a stage of manufacture.

Referring first to FIGS. 1 and 2, an absorbent mop swab 10 includes an outer casing 14 formed from absorbent typically fabric, material and having a pair of major surfaces 16 and 18 which are each provided by a layer of an absorbent sheet. This material can be a woven fabric material or made from nonwoven fibres and can be recycled waste material or purpose made material as required.

In this embodiment, the outer casing 14 is formed from separate sheets which provide the upper and lower major surfaces 16, 18 of material, although in another embodiment, the outer casing 14 could be provided by a single sheet of absorbent material which is folded back on itself to provide the pair of major surfaces 16, 18.

The swab 10 also includes an absorbent inner filling 20 which is provided within and enveloped by the outer casing 14 interposed between the opposite major surfaces 16, 18. The inner filling 20 preferably has an absorbency which is greater than that of the outer casing 14.

The inner filling 20 is in this example an interlaced structure or fine mesh, such as a matted wadding, or a felted or woven material, or a nonwoven fibre material, which may be provided by a waste or purpose made absorbent material.

Preferably as shown in FIG. 1, the inner filling 20 is provided as a web which can be rolled and unrolled without disintegrating, but alternatively, the inner filling 20 could be provided by slivers of a suitable absorbent material. For example, the inner filling 20 can be or may include strips of waste newspaper, trimmings from clothes and teabags, and such like.

As indicated in FIG. 1, one method of making the mop swab 10 may include using three rolls of material 22, 24, 26. The first roll 22 of material provides a sheet for the one major surface 16 of the outer casing 14, whilst a second roll 23 provides the inner filling 20 web, and the third roll 26 provides a sheet for the other major surface 18 of the outer casing 14. The web of inner filling 20 is fed between the opposite major surfaces 16, 18 of the outer casing 14 as each of the rolls 22, 24 and 26 are unrolled.

Multiple primary rows of stitching, some of which are indicated by the reference 22, and which in this example extend in generally the same direction, i.e. in the direction of feed of the materials 16, 18, 20, are then used to attach the upper and lower major surfaces 16, 18 through the inner filling 20, and also with each other, to form a plurality of individual elongate pockets of which extend along a length of the mop swab 10.

The stitching 22 serves to prevent or limit undesirable movement or displacement of the inner filling 20 in the outer casing 14 as well as to separate the pockets of material.

Opposed edges of the outer casing sheets 16, 18 from the rolls 22 and 26 are also attached together e.g. by stitching, either directly in contact with one another, or with inner filling material 20 therebetween. In FIG. 2, opposed edges at opposite sides 32, 33 are shown attached together, whilst a leading edge 30 is shown in an unattached condition. As shown in the drawings, the primary rows of stitching 22 in this example extend generally parallel to one another in spaced relationship in order to form the individual pockets.

Figure 3:
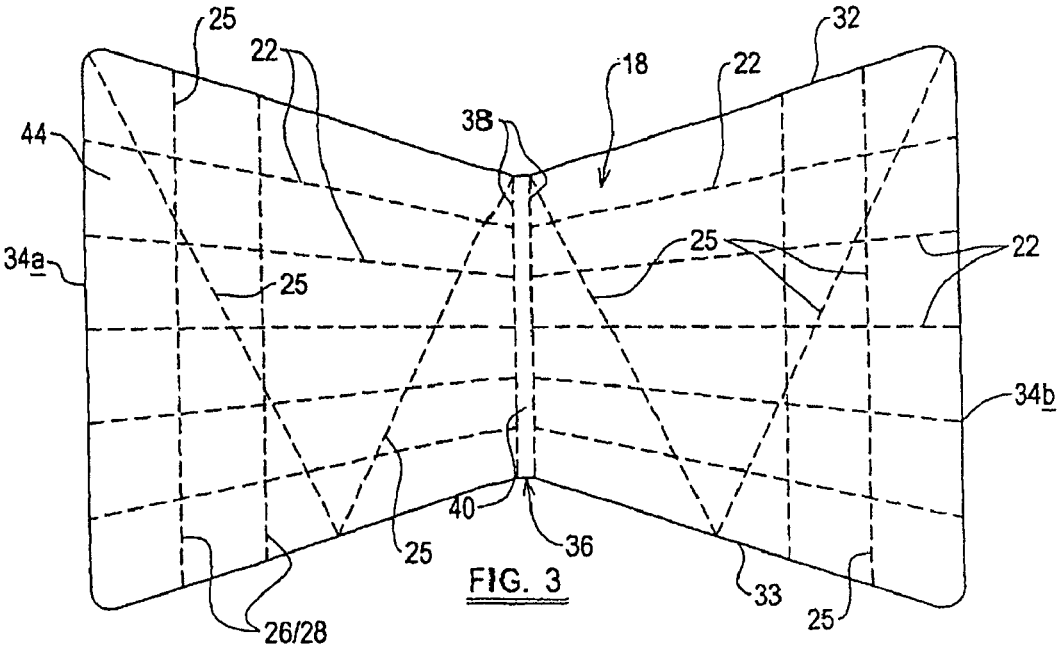
FIG. 3 is an illustrative view of a mop swab which has been processed for making a mop.
Figure 4:
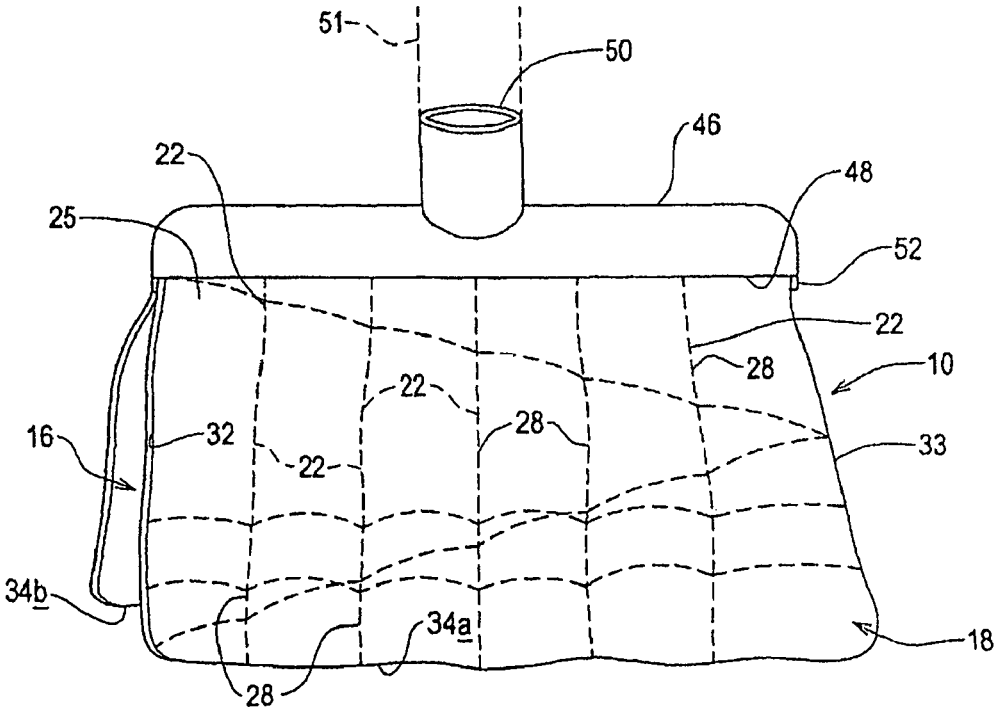
FIG. 4 is an illustrative view of a mop holder, holding a mop swab of FIG. 3 with the mop swab in contact with the surface to be mopped.

As desired, depending mainly on the size of the mop swab 10 to be produced, one or more secondary rows of cross stitching 25 can also be used more positively to retain the inner filling 20 in place within the outer casing 14. Such cross stitching 25 which is shown in FIGS. 3 and 4 will divide the lengths of the pockets provided by the primary rows 22 of stitching. The cross stitching 25 may extend diagonally or generally laterally of the primary rows of stitching 22 as required.

The stitching 22, 25 effectively cinches the inner filling 20 between the opposite major surfaces 16, 18 of the outer casing 14. This results in there being a plurality of depressions 28 formed in the major surfaces 16, 18 of the outer casing 14 which in the example are primarily a plurality of elongate generally parallel depressions 28, i.e. channels or troughs, and a plurality of cross depressions formed by the cross stitching 25. Such plurality of depressions 28 extend over substantially the entire major surfaces 16, 18 of the outer casing 14.

The mop swab 10 produced by the method described can be of any desired size and may be used to form a single mop as hereinafter described, or the mop swab 10 may be divided in size to provide a plurality of mop swab parts each of which may be used to form a mop. Thus each mop swab part may itself be a mop swab in accordance with the invention, in which there is inner filling material 20 enveloped within an outer casing 14.

The mop swab 10 shown in FIG. 2 can be divided by cutting the mop swab 10 laterally or longitudinally as required, with any unfinished opposed edges stitched together so that the inner filling 20 is wholly enveloped within the outer casing 14 of the mop swab 10 or each mob swab part.

To process the mop swab 10 to provide a mop of the kind shown in FIG. 4, in which the mop swab 10 depends from a mop holder, the mop swab 10 is formed to a length which corresponds to twice the desired depending or hanging length of the mop swab 10 as measured from a mop holder 46 to which the mop swab 10 will be attached to the lowest free edge of the mop swab furthest from the mop holder 46.

As can be seen from FIG. 3, the primary rows of stitching 22 which attach the major surfaces 16 and 18 of the outer casing 14 through the inner filling 20, will extend longitudinally of the length of mop swab 10 and perpendicularly from what will become the lowest free edges 34*a*, 34*b* of the mop swab 10.

A central portion 36 of the mop swab 10 is then gathered from both sides to form a waisted portion which the mop swab 10 flares outwardly. The waisted portion 36 is formed by one or more rows of cross stitching 38 which extend across the mop swab 10, laterally or substantially laterally to the primary rows of stitching 22. The waisted portion 36 defines a reinforced headband portion 40 for connection to a mop holder 46 of the mop to be produced.

In FIG. 4, there is shown a mop holder 46 which provides a straight elongate channel 48 in which the headband portion 40 of the mop swab 10 is received and retained for example by a retaining device 52. A fastening for a handle, namely in this example a socket 50, but this could alternatively be a spigot, e.g. a threaded spigot, is provided on the mop holder 46 to enable a mop handle 51 to be fastened to the mop holder 46. The position of the handle 51 is indicated in dotted lines in FIG. 4.

Although the mop swab 10 can be permanently connected to the mop holder 46, desirably the retaining means 56 is a releasable clamping element which allows removal of the mop sheet 12 from the channel 48 for cleaning or replacement. Consequently the mop swab 10 can be manufactured with the intention of being disposable once soiled.

A variant of the assembly of mop holder 46 and mop swab 10 shown in FIG. 4 is one in which the channel 48 which receives the mop swab 10, instead of being elongate, is curved, e.g. circular. In this example, the headband portion 40 of the mop swab 10 is preferably formed at one end of the mop swab 10 instead of at the centre as indicated in FIG. 3, and the mop swab 10 is clamped in the curved channel so as to depend therefrom to provide a mop swab 10 and mop holder 46 assembly in which the mop swab 10 is in a generally conical or frustoconical shape.

A mop swab 10 of the invention may be formed to any desired size for example of up to one meter or more in length, i.e. the direction along which the primary rows of stitching 22 extend. The width of the mop swab 10 could also be up to one meter or more. Desirably a single mop swab 10 is attached to the mop holder to extend generally the full width of the mop holder to provide the mop, but where multiple mop swabs are provided, preferably each has a width of at least 5 cm and preferably at least 10 cm. The overall thickness of the mop swab 10 between the outer major surfaces 16, 18 could typically be in the range of 5 mm to 25 mm or more. The mop swab 10 may be divided to provide a plurality of mop swab parts which may each be used to provide a plurality of mop swabs of many different sizes.

In a variation to the mop swab 10 and mop holder 46 assembly shown in FIG. 4, if desired, the mop swab 10 may be attached to the mop holder 46 so that the primary rows of stitching 22 which attach the opposite major surfaces 16, 18 of the mop swab 10 together, could extend in generally the same direction as the channel 48 in which the mop swab 10 is received. However, in order to minimise drag as the mop swab 10 is moved over a surface to be mopped, preferably the primary rows of stitching 22 extend in a direction which generally coincides with the direction in which the mop swab 10 is moved over the surface to be mopped.

The depressions 28 formed in the opposite major surface 16, 18 of the mop swab 10 by the cinching together of the opposite major surfaces of outer casing through the inner filling 20, reduce a contact area between the outer casing 14 and a surface being mopped. Therefore despite the mop swab 10 being potentially fully charged with cleaning or other liquid, and thus being reaonsably heavy, drag created by the outer casing 14 as it is moved over the surface being mopped, is greatly reduced, thereby increasing the manoeuvrability of the mop.

Figure 5:
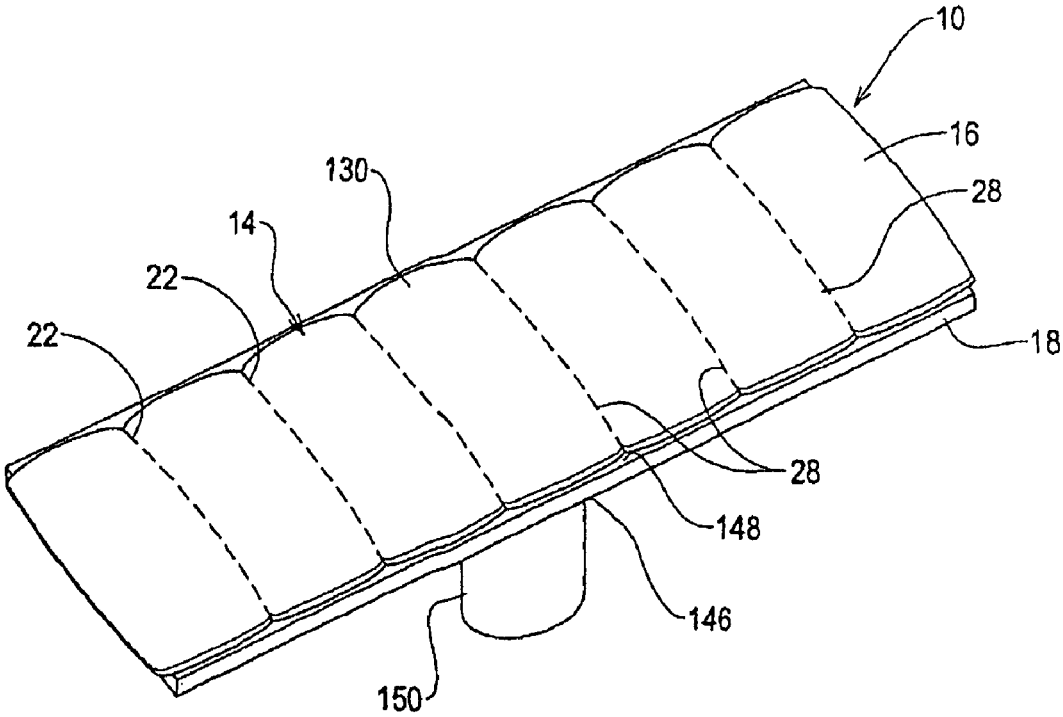
FIG. 5 is a perspective view from below of another embodiment of a mop swab holder and mop swab assembly.

Referring to FIG. 5, the mop swab 10 of FIG. 2 could be divided to provide a mop swab part 100 for use in forming a second embodiment of a mop swab 100 and mop holder 146 assembly as shown in which the mop swab 100 is used flat against a surface to be mopped, in this example with outer casing 14 major surface 16 contacting the surface to be mopped. In the FIG. 5 embodiment, the width of the mop swab 100 is not less then 100 mm but its length is much shorter. The primary rows of stitching 22 extend in generally the same direction as the mop swab 100 is moved over surface to be mopped. Although not shown, cross stitching may also be provided as desired. The major surface 16 of the outer casing 14 which is presented to the surface to be mopped thus includes the plurality of generally parallel depressions 28 thus to reduce the drag between the mop swab 100 and the surface to be mopped. The mop swab 100 is secured to a mop holder 146 which includes a elongate planar or substantially planar support surface 148 against which the mop swab 100 abuts and is retained at least during use. Again a socket 150 to facilitate the fastening of a mop handle to the mop holder 146 is also provided by the mop holder 146, at an opposite side of the planar or substantially planar surface 148 but on the opposite side thereto of the mop swab 100.

The mop holder 146 may be made collapsible and re-erectable, to allow for storage and occasional ringing of the mop swab when necessary.

Means for connecting the mop swab 100 to the mop holder 146 are provided, which may be in the form of press studs, hook and loop fastening devices (e.g. Velcro (registered trade mark)) or any other suitable means for releasable or permanent connection between the planar surface 148 of the mop holder 146 and the major surface 18 of the mop swab 100 opposite to the major surface 16 which in use contacts the surface to be mopped.

The configuration of mop swab 10, 100 described above, provides an effective and low cost mop swab 100 which will be useable for several times before disposal. The cost of manufacturing can be made sufficiently low to make disposal cost effective although particular when using durable materials, a mop swab 100 which may be reused many times, could be provided.

It will be appreciated that in each of the embodiments of mop swab 10, 100 described above, by virtue of the outer casing 14 enveloping the inner filling 20, and by virtue of the stitching 22, 25 which attaches the opposite major surfaces 16, 18 of the outer casing 14 through the inner filling 20, a substantial volume of voids are provided in the pockets formed by the stitching 22, 25 and the attached free edges of the outer casing 14.

These voids will trap significant volumes of air within the outer casing 14, greater than would be achieved with a bonded layer construction, or a single layer construction.

The absorbent material of the outer casing 14 will in use, collect a significant amount of dirt from the surfaces being mopped, which will not pass with the liquid, into the inner filling 20. Upon wringing the mop swab 10, 100, the trapped air will efficiently remove the collected dirt as the air and liquid from the inner filling 20, pass through the outer casing 14 material. By virtue of the inner filling 20 being enveloped within the outer casing 14, and the stitching 22, 25 forming the individual pockets, all the trapped air which is wrung from the inner voids, is constrained to pass through local outer casing 14 material.

Even when simply immersing a soiled swab 10, 100 into e.g. cleaning liquid, escaping air from the inner voids will efficiently remove at least some of the collected dirt.

Various modifications may be made without departing from the scope of the invention. For example, in the example described, the outer casing 14 is made from two separate layers or sheets 16, 18 of absorbent material, with four opposed edges of the sheets attached together e.g. by stitching, so that the outer casing 14 envelopes the inner filling 20. In another example, the outer casing 14 may be formed from a single sheet of absorbent material wrapped about the inner filling 20 to form the opposite major surfaces 16, 18, and the opposed three edges of the wrapped sheet being attached together with the inner filling 20 interposed between the major surfaces 16, 18, for example by stitching, so that the outer casing 14 envelopes the inner filling 20. If desired the opposite major surfaces 16, 18 may be attached together through the inner filling otherwise than by stitching.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An assembly comprising:

a mop swab holder; and a mop swab, wherein the swab comprises an outer casing and an inner filling, the outer casing being made of an absorbent material and enveloping the inner filling, and the inner filling being made of an absorbent material, opposite major surfaces of the outer casing being attached together through the inner filling by a plurality of spaced rows of stitching extending in a same direction to each other to form a plurality of pockets extending in the same direction, the pockets forming a plurality of depressions in the opposite major surfaces of the outer casing and the stitching limiting movement of the inner filling within the outer casing, and wherein the mop swab holder including a channel to receive a part of the mop swab such that in use, the mop swab depends from the mop swab holder with the plurality of rows of stitching extending longitudinally downwardly from the holder.

2. The assembly according to claim 1, wherein the stitching together of the opposite major surfaces of the outer casing through the inner filling, forms the swab with a plurality of pockets in each of the plurality of pockets are voids in which in use, significant volumes of air are trapped.

3. The assembly according to claim 2, wherein the voids include voids between the outer casing and the inner filling.

4. The assembly according to claim 1, wherein additionally, cross stitching is provided to divide lengths of the pockets.

5. The assembly according to claim 1, wherein the outer casing is formed from a single sheet of absorbent material wrapped about the inner filling to form the opposite major surfaces, and opposed three edges of the wrapped sheet being attached together with the inner filling interposed between the major surfaces so that the outer casing envelopes the inner filling.

6. The assembly according to claim 1, wherein the outer casing formed from two separate sheets of absorbent material to provide the opposite major surfaces of the outer casing, and between the opposite major surfaces of the outer casing the inner filling is interposed, four opposed edges of the two sheets being attached together so that the outer casing envelopes the inner filling.

7. The assembly according to claim 1, wherein the absorbent outer casing is made from one of a woven fabric material and a nonwoven fibre material.

8. The assembly according to claim 1, wherein the inner filling is an interlaced structure.

9. The assembly according to claim 8, wherein the inner filling material is one of or a mixture of more than one of a matted absorbent material, a felted or woven fabric or material, and a nonwoven fibre.

10. The assembly according to claim 1, wherein fastening means secure an edge of the mop swab in the channel.

11. The assembly according to claim 1 wherein the channel is one of elongate and curved.

12. The assembly according to claim 1, wherein the mop swab holder includes a handle fastening for fastening a handle to the mop swab holder.

13. An assembly comprising:

a mop swab holder; and a mop swab, wherein the swab comprises an outer casing and an inner filling, the outer casing being made of an absorbent material and enveloping the inner filling, and the inner filling being made of an absorbent material, opposite major surfaces of the outer casing being attached together through the inner filling by a plurality of spaced rows of stitching extending in a same direction to each other to form a plurality of pockets extending in the same direction, the pockets forming a plurality of depressions in the opposite major surfaces of the outer casing and the stitching limiting movement of the inner filling within the outer casing, and wherein the mop swab holder comprises a support surface having a greater width than length, and against which the mop swab abuts and is retained in use as the assembly is moved, with the mop swab flat, over a surface to be mopped, and the rows of stitching of the swab extending in generally the same direction as the assembly is moved over the surface to be mopped.

14. The assembly according to claim 13, wherein the mop swab holder is attached to one of the opposite major surfaces.

15. A mop including in combination a swab and mop swab holder assembly and a handle fastened to the mop swab holder wherein the swab includes an outer casing and an inner filling, the outer casing being made of an absorbent material and enveloping the inner filling, and the inner filling being made of an absorbent material, opposite major surfaces of the outer casing being attached together through the inner filling by a plurality of spaced rows of stitching extending in the same direction to each other to form a plurality of pockets extending in the same direction, the pockets forming a plurality of depressions in the opposite major surfaces of the outer casing and the stitching limiting movement of the inner filling within the outer casing, and the mop swab holder including a channel to receive a part of the mop swab such that in use, the mop swab depends from the mop swab holder with the plurality of rows of stitching extending longitudinally downwardly from the holder.

16. An assembly comprising:

a mop swab holder; and a mop swab, wherein the swab comprises an outer casing and an inner filling, the outer casing being made of an absorbent material and enveloping the inner filling, and the inner filling being made of an absorbent material, opposite major surfaces of the outer casing being attached together through the inner filling by a stitching limiting movement of the inner filling within the outer casing, and wherein the mop swab holder comprises a channel to receive a part of the mop swab such that in use, the mop swab depends from the mop swab holder.

* * * * *